US010533772B2

(12) United States Patent
Lemon et al.

(10) Patent No.: US 10,533,772 B2
(45) Date of Patent: Jan. 14, 2020

(54) MOVABLE AIR-FLOW GUIDE VANE FOR A FURNACE

(71) Applicant: TRANE INTERNATIONAL INC., Davidson, NC (US)

(72) Inventors: Angus Robert Lemon, Tyler, TX (US); Nathan Wagers, Henderson, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 151 days.

(21) Appl. No.: 15/422,149

(22) Filed: Feb. 1, 2017

(65) Prior Publication Data

US 2018/0216850 A1 Aug. 2, 2018

(51) Int. Cl.

| | |
|---|---|
| ***F24H 9/20*** | (2006.01) |
| ***F24H 3/06*** | (2006.01) |
| ***F24H 9/00*** | (2006.01) |

(52) U.S. Cl.

CPC ..... *F24H 9/2085* (2013.01); *F24H 3/065* (2013.01); *F24H 9/0063* (2013.01)

(58) Field of Classification Search

CPC ..... F24H 9/2085; F24H 9/0063; F24H 3/065
USPC ..... 126/110 A, 99 D, 116 A; 165/280, 283, 165/297, 227, 244
See application file for complete search history.

(56) References Cited

U.S. PATENT DOCUMENTS 1,626,172 A * 4/1927 Wolfe ..... F28D 1/024 126/110 A
1,849,061 A 3/1932 Anderson
2,025,937 A * 12/1935 Dean ..... F24F 5/0007 165/229
2,191,224 A * 2/1940 Adair ..... F28D 1/024 165/100
2,521,866 A * 9/1950 Ott ..... F24H 9/2085 110/304
3,122,202 A 2/1964 Scharres
3,252,509 A 5/1966 Keegan
3,650,318 A 3/1972 Avery
3,716,097 A 2/1973 Kelp et al.
3,735,809 A 5/1973 Matsumisha
3,833,053 A 9/1974 Benteler et al.
3,958,628 A * 5/1976 Padden ..... F24F 3/14 165/222
3,990,504 A 11/1976 Kolthoff, Jr.
4,033,320 A 7/1977 Jury
4,155,699 A * 5/1979 Hansen ..... F23L 3/00 126/285 B
4,325,352 A * 4/1982 Dirkes ..... F24H 3/0488 126/110 A (Continued)

*Primary Examiner* — Gregory L Huson
*Assistant Examiner* — Daniel E Namay
(74) *Attorney, Agent, or Firm* — Hamre, Schumann, Mueller & Larson, P.C.

(57) ABSTRACT

A furnace system featuring baffles, each set of baffles including one or more movable vanes, and systems for controlling the positioning of movable vanes during furnace operation. Actuators may be used to move vanes between deployed and retracted positions, the actuators controlled by units within the furnace or linked to the power sources for furnace elements which are specific to either heating or cooling operations. The movable vanes may alternately be positioned by using springs with stiffness selected to place vanes in a deployed position when under heating airflows and in a retracted position when under cooling airflows.

6 Claims, 4 Drawing Sheets

(56) References Cited

U.S. PATENT DOCUMENTS 4,326,667 A 4/1982 Murata et al.
4,328,926 A 5/1982 Hall
4,403,649 A 9/1983 Herschel et al.
4,429,679 A * 2/1984 Dirkes ..... F24H 3/0488 126/110 A
4,458,665 A 7/1984 Vandervaart
4,696,340 A 9/1987 Nagao et al.
4,971,137 A 11/1990 Thompson
5,056,500 A * 10/1991 Evens ..... F23L 3/00 126/110 R
5,113,928 A 5/1992 Myers
5,560,350 A * 10/1996 Kim ..... F23G 7/065 126/110 A
5,993,195 A * 11/1999 Thompson ..... F23N 1/067 126/116 A
6,564,794 B1 5/2003 Zia et al.
6,564,795 B1 5/2003 Sears et al.
6,629,523 B2 * 10/2003 Saltzman ..... F24C 15/20 126/110 A
6,732,728 B2 5/2004 Hill et al.
6,851,469 B2 2/2005 Sears et al.
7,334,632 B2 2/2008 Bassilakis
8,656,905 B2 2/2014 Noman et al.
2005/0268903 A1 12/2005 Bassilakis
2009/0114206 A1 * 5/2009 Post ..... F04D 29/422 126/110 R
2010/0078007 A1 * 4/2010 Post ..... F04D 29/422 126/112
2011/0189005 A1 * 8/2011 Post ..... F04D 29/44 415/204
2012/0193075 A1 8/2012 Reese et al.
2012/0199109 A1 * 8/2012 Thompson ..... F27D 19/00 126/112
2013/0225060 A1 * 8/2013 Heberer ..... F24F 11/0079 454/256
2013/0284115 A1 * 10/2013 Kim ..... F24H 9/2035 122/14.21
2014/0007859 A1 * 1/2014 Post ..... F04D 29/422 126/110 A
2014/0150775 A1 6/2014 Noman et al.
2014/0199643 A1 * 7/2014 Smelcer ..... F23N 3/00 431/12

* cited by examiner

MOVABLE AIR-FLOW GUIDE VANE FOR A FURNACE

FIELD

A system using a plurality of movable vanes to direct airflows within a furnace that operates in cooling as well as heating modes.

BACKGROUND

In furnaces, baffles are often used to direct airflow over heat exchangers to increase the amount of heat transferred to the air and thus increase furnace efficiency. However, these baffles cause a pressure drop, requiring greater power consumption by the air moving motor. In furnace systems additionally featuring cooling such as air conditioning, the pressure drop and increased air moving motor power consumption created by the baffles exists even when the heat exchangers are not in use, making the system less energy efficient when used for cooling, as air must still be driven through the baffles. This produces a tradeoff between furnace heating performance such as Annual Fuel Utilization Efficiency (AFUE) and air conditioning system efficiency such as Energy Efficiency Ratio (EER), because of the increased resistance to air movement added by baffles systems directing airflow over the heat exchangers in the furnace.

SUMMARY

In an embodiment may be a furnace system with a baffles system for each of a primary heat exchanger and a secondary heat exchanger, with one or more movable vanes in each of the baffles systems. The movable vanes can be moved between retracted and deployed positions as needed to enhance the efficiency of cooling or heating operations, respectively, by directing airflow over heat exchangers to improve heating efficiency, or reduce resistance to airflow in the furnace cabinet to improve cooling efficiency. The vanes may be controlled by a vane position control such as actuators, for example, servo motors, or vane position may be controlled through the use of variable-position mechanical connectors, such as springs with stiffness selected such that in a heating airflow, the vanes are held in a deployed position by the springs, while a cooling airflow moves the vanes into a retracted position.

The movable vanes may be controlled by an actuator such as a servo motor, which is controlled either through a controller receiving signals from other furnace components such as integrated furnace controls or thermostats, or controlled by linking its power supply to the power supply for a furnace element which is specific to either a heating operation or a cooling operation of the furnace. Alternatively, the position of the movable vanes may be governed by variable-position mechanical connectors, such as springs with stiffness selected such that the movable vanes are deployed during a heating airflow, while a cooling airflow may overcome the spring stiffness to move the vanes into their retracted positions.

In an embodiment a method for controlling airflow in a furnace cabinet includes one or more movable vanes being in a deployed position during heating operations and the movable vanes being in a retracted position during cooling operations, and where the retracted position of the vanes offers less resistance to airflow through the furnace than the extended position of the vanes. The positioning of the vanes may be controlled by an actuator linked to a controller, through an actuator linked to the power source for a component which is specific to either heating or cooling operations, or through forces exerted on the vanes by the airflow and by springs connected to the vanes.

In an embodiment a control system includes a controller receiving a signal from another furnace component, a power source connected to the controller, and an actuator linked to a movable vane, with the controller governing the powering of the actuator based on the signal from the other furnace component. The furnace component may be a general furnace control such as a thermostat or integrated furnace control (IFC), or may be a component specific to heating or cooling operations. The supply of power to the actuator may be governed by the state of the movable vane when the actuator is not powered, and by control logic ensuring that the movable vane is deployed during heating operations and retracted during cooling operations.

Embodiments of the invention may reduce the power consumption of a blower motor during cooling operations by approximately 7% or more when compared to fixed baffles systems, by removing guide vanes from the air flow path through a furnace.

DRAWINGS

DETAILED DESCRIPTION

Furnace efficiency may be improved in both heating and cooling operations by incorporating movable vanes into baffles systems used in furnaces. Control of those movable vanes within the baffles allows the resistance to airflow to be adapted to the cooling or heating operation taking place, for example lowering the resistance of the furnace system to airflow during cooling operations, or increasing the deflection of air over heat exchangers during heating operations. By removing heating guide vanes from the path of the airflow through a furnace, it is possible to reduce the power required by a blower motor during cooling operations by approximately 7% or more.

Figure 1:
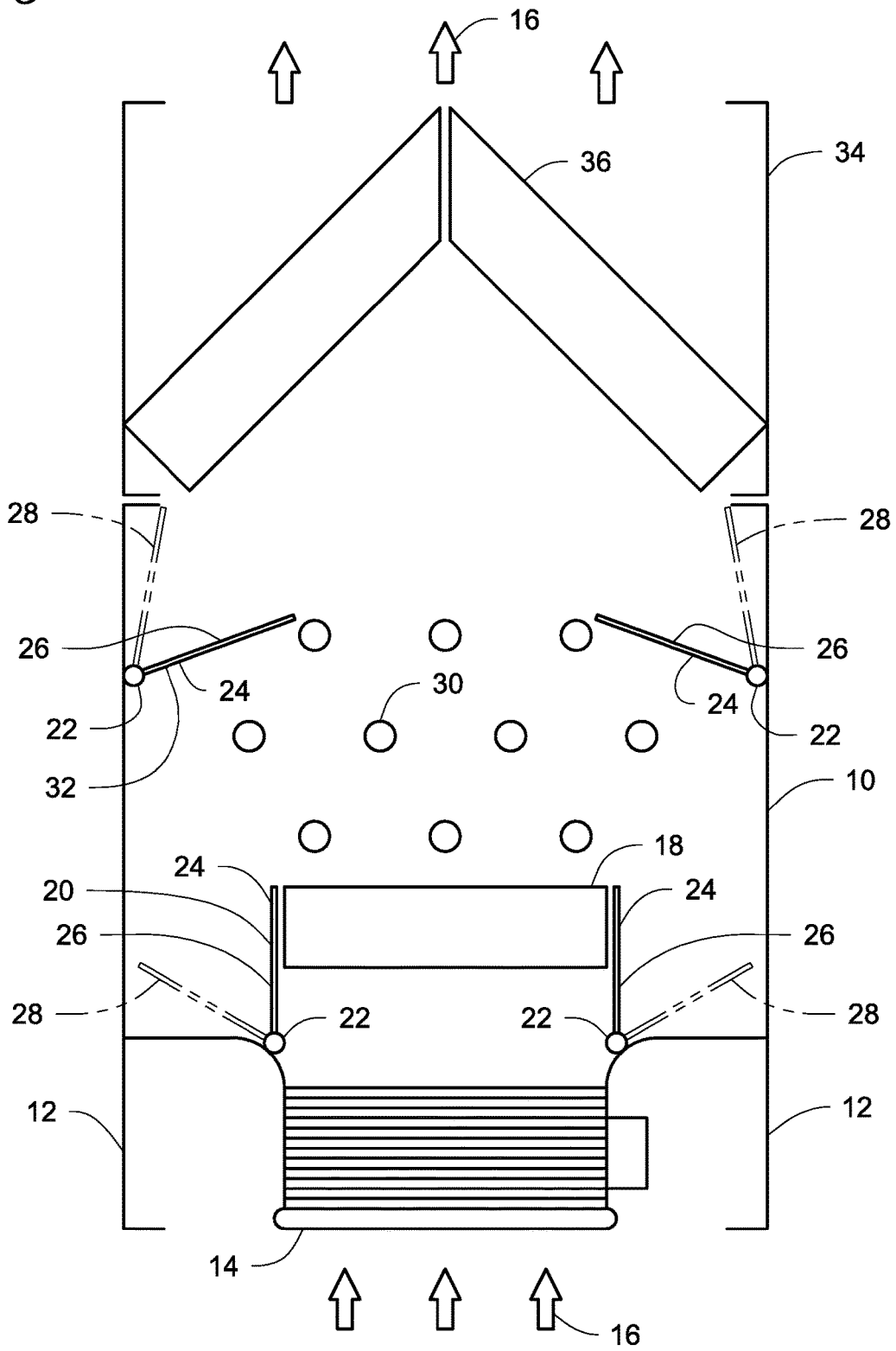
FIG. 1 is an embodiment of a furnace featuring baffles with movable vanes, and the air flow therethrough.

FIG. 1 is a diagram showing the airflow through a furnace with movable guide vanes. Blower 14 drives air into and through a furnace cabinet 10. The furnace cabinet 10 has side walls 12. Movable vanes 24 may be connected to one or more of the side walls 12 of the furnace cabinet 10 or to other points within the furnace cabinet, such as elements of the furnace, for example, the exterior of the secondary heat exchanger 18. This connection may be through a hinge 22 or other movable connectors such as, for example, ball joints or swivels. The movable vanes 24 may be moved between a deployed position 26, increasing the extent to which they deflect air over the secondary heat exchanger and/or the primary heat exchanger, or a retracted position 28 allowing air to pass through that section of the furnace more freely.

The blower 14 directs an airflow 16 through a furnace cabinet 10. Blower 14 is an air-moving unit such as an axial fan or a housed fan. The furnace cabinet has side walls 12. Hinges 22 for movable vanes 24 and a vane position control for the movable vanes, such as actuators mechanically linked to the vanes or variable-position mechanical connectors such as springs connected to the vanes may be mounted on the inside of these furnace cabinet walls 12.

On leaving the blower 14, the airflow 16 enters the set of secondary heat exchanger baffles 20 and is directed over the secondary heat exchanger 18. The secondary heat exchanger 18 is a heat exchanger which transfers heat to the airflow 16 during heating operations. The secondary heat exchanger 18 may be, for example, a tube-and-fin heat exchanger. The secondary heat exchanger transfers heat to the airflow 16 during heating operations.

The secondary heat exchanger baffles 20 include one or more movable vanes 24, and direct the airflow 16 through the furnace cabinet 10. In the deployed position 26, the vanes 24 direct airflow to and through the secondary heat exchanger 18, increasing the efficiency of the heat exchanger and allowing greater transfer of heat to the airflow 16 during heating operations.

The vanes 24 of the secondary heat exchanger baffles 20 may also take a retracted position 28, for example during cooling operations of the furnace system. In the retracted position 28, the vanes 24 allow the airflow 16 to pass the secondary heat exchanger baffles 20 with less resistance, for example by increasing the space between the surface of the vanes 24 and the secondary heat exchanger 18.

The airflow 16 then enters the primary heat exchanger baffles 32 and the primary heat exchanger 30. The primary heat exchanger baffles 32 include movable vanes 24 which may move between a deployed position 26 and a retracted position 28. The primary heat exchanger 30 is a heat exchanger, shown in FIG. 1 as a set of tubes perpendicular to the plane of the cross-section of the furnace, which carry heated fluid during the heating operation of the furnace and enable the transfer of heat from that fluid to the airflow 16. In the deployed position 26, the vanes 24 of the primary heat exchanger baffles 32 deflect the airflow 16 over and through the primary heat exchanger 30, increasing the amount of heat the primary heat exchanger 30 transfers to the airflow 16, increasing the efficiency of heating operations of the furnace.

In the retracted position 28, the movable vanes 24 of primary heat exchanger baffle 32 may provide more space between the surface of the vanes 24 elements of the primary heat exchanger 30. The vanes 24 in the retracted position provide less resistance to the airflow 16 as it moves past the primary heat exchanger 30 through the furnace cabinet 10.

Once the airflow has moved past the primary heat exchanger 30, it may leave the furnace cabinet 10 and enter the air conditioner cabinet 34. In the air conditioner cabinet 34, the airflow may, in cooling operations, be cooled by the air conditioner coil 36. The airflow may then exit the air conditioner cabinet 34 and be distributed to a building, for example a dwelling, which is heated and/or cooled by the furnace.

Figure 2:
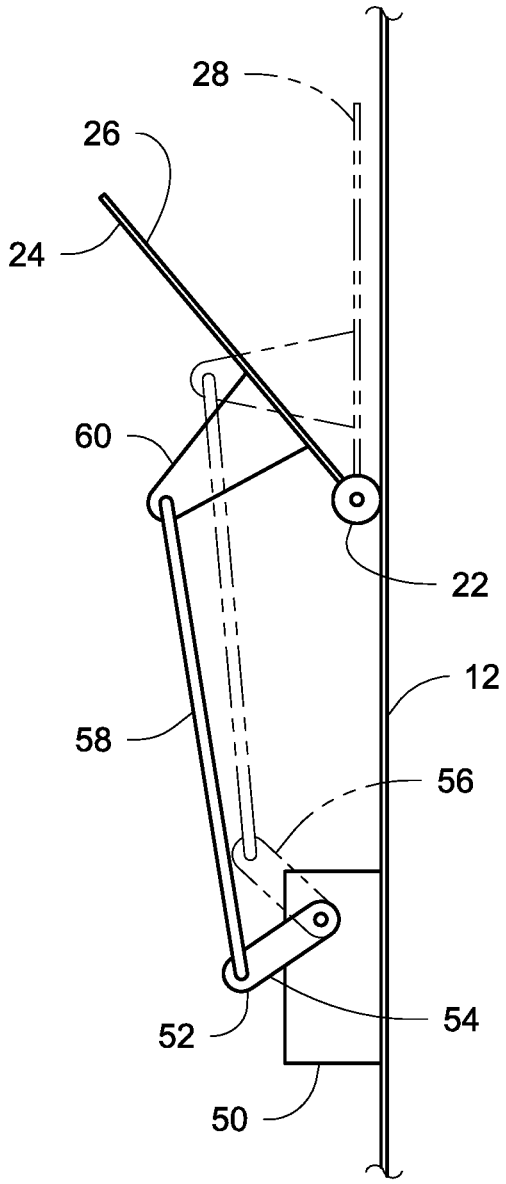
FIG. 2 is an embodiment of an actuator-controlled movable vane.

FIG. 2 displays an embodiment of a movable vane assembly used to control the positioning of a vane 24 in some baffles systems. Vane actuator 50 moves an arm 52, to which rod 58 is connected; the arm 52 may be moved between a deployed arm position 54 and a retracted arm position 56. Vane actuator 50 may be an electric motor, for example a servo motor. Rod 58 is also connected to movable vane 24 through, for example, a mounting bracket 60. When arm 52 is in the deployed position 54, the vane 24 is in deployed position 26. In the deployed position 26 depicted in FIG. 2, the vane deflects airflows, for example to increase the airflow 16 over heating elements such as the primary or secondary heat exchanger of a furnace during heating operations. When arm 52 is in the retracted position 56, the vane 24 is in the retracted position 28, providing less resistance to airflow 16 moving through the furnace cabinet 10, for example during cooling operations. The vane actuator 50 may be located on a side wall 12 of the furnace cabinet 10. The vane 24 may also be connected to the side wall 12 of the furnace cabinet 10, through a hinge 22 or through another movable mechanical link such as a ball joint or swivel.

Figure 3A:
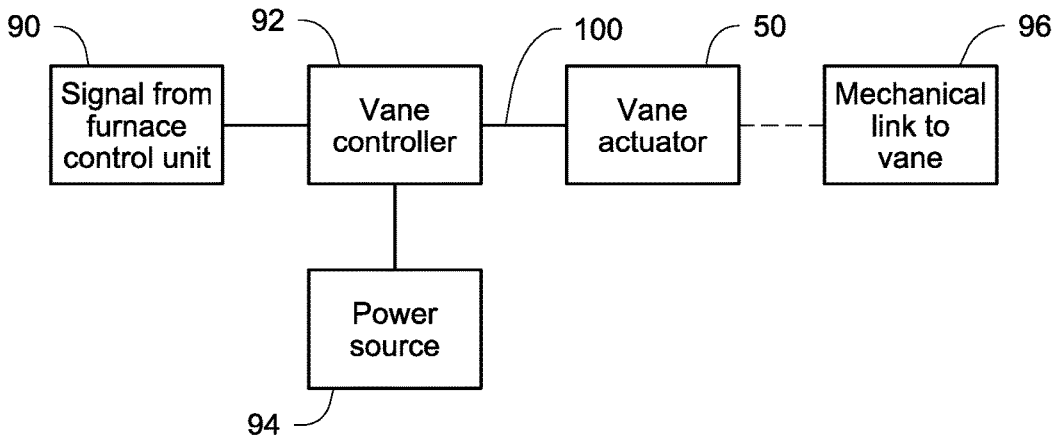
FIG. 3A is an embodiment of a control system for a movable vane.

FIG. 3A shows one embodiment of a control system for one or more movable vanes operated by an actuator, such as the movable vane assembly example shown in FIG. 2. In the embodiment depicted in FIG. 3A, a control signal 90 is sent to a vane controller 92, which controls the supply of power 100 from a power source 94 to the vane actuator 50 which controls the position of the vane 24 via a mechanical linkage 96.

The control signal 90 may be from a control unit elsewhere in the furnace system, for example a signal from an integrated furnace control, or a call for heating or cooling from a thermostat. In this embodiment, the control logic is tied to the nature of the operation indicated by the signal. For example, when the control signal 90 is a call for cooling from the thermostat, the power to the vane actuator by the power supply 94 is provided or cut off by the vane controller 92 based on the default un-actuated position of the vane, in order to put the vane into its retracted state. When the control signal 90 is a call for heating from a thermostat, the power from the power supply 90 is provided or cut off by the vane controller 92 based on the default, un-actuated state of the vane to put the vane into a deployed position. A control signal 90 from an integrated furnace control could be an instruction to put the vane into the retracted or deployed position. The control signal 90 may be from a controller that is also coupled to another element that is specific to a heating or cooling operation, such as an inducer controller, or a gas valve for heating operations, or an outdoor unit, compressor or air conditioner fan for cooling operations. For such linked controls, the control logic is to put the vane in the deployed position when a linked heating-specific furnace element is active, or to put the vane in the retracted position when a linked cooling-specific furnace element is active. In some embodiments, a vane controller 92 may be linked to multiple vanes 24, controlling the actuation of each of those vanes. The vane actuator 50 may act by moving an element connected to the mechanical link to the vane 96, for example the arm 52 shown in FIG. 2.

The power source 94 is a source of electrical power used to operate the vane actuator 50; it may be, for example, a battery or a connection to a power source such as a connection to the AC wiring of a building the furnace. Power 100 is electrical power of sufficient type, amplitude and voltage to operate the vane actuator 50.

The mechanical link 96 is a mechanical interface through which movement of an element of the vane actuator 50 may act on the movable vane 24 to alter the position of the movable vane 24, for example, the rod 58 and bracket 60 shown in FIG. 2 which are moved by the arm 52 extending from the vane actuator.

Figure 3B:
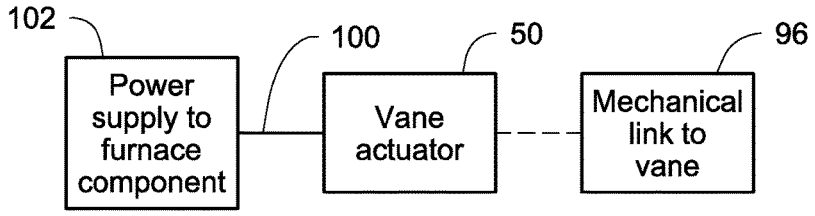
FIG. 3B is another embodiment of a control system for a movable vane.

FIG. 3B shows another 50 embodiment of a control system for one or more movable vanes operated by an actuator. In the embodiment depicted in FIG. 3B, the vane actuator 50 for the vane 24 is linked directly to the power supply 102 for a furnace component, with the furnace component being one which is exclusively in operation either for heating phases of operation or cooling phases of operation. The default and actuated conditions for the vane 24, for example whether the vane 24 is in a deployed or retracted position when the vane actuator 50 is not active, may be selected based on the particular furnace component sharing a power supply 102 with the vane actuator 50. For example, the power supply 102 to the vane actuator may be the power supply 102 used by a heating-specific component or a cooling-specific component. When that heating-specific or cooling-specific component is activated and the power supply 102 provides power 100, the vane actuator 50 is also powered and moves the vane into the actuated position. For example, when the vane actuator 50 is powered by the power source 102 for a heating-specific component such as the gas valve or inducer, the actuated position of the movable vane 24 may be the deployed position 26 and the default, un-actuated position of the movable vane may be the retracted position 28. In examples where the vane actuator 50 is powered by the power supply 102 of a cooling-specific component such as an outdoor unit of an air conditioner, a compressor, or a fan, the actuated position of the movable vane 24 may be the retracted position 28, providing less resistance to airflow through the furnace cabinet, and the default, un-actuated position of the movable vane may be the deployed position, deflecting air over one or more heat exchangers.

Figure 4A:
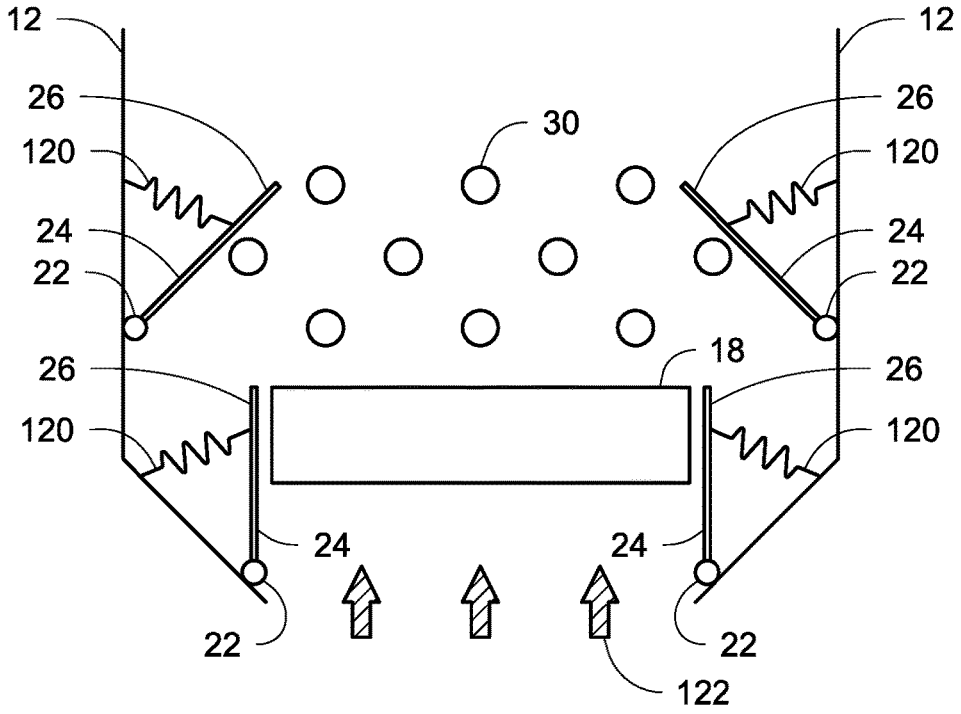
FIG. 4A is an embodiment of a furnace system with spring-positioned vanes in in a heating mode.
Figure 4B:
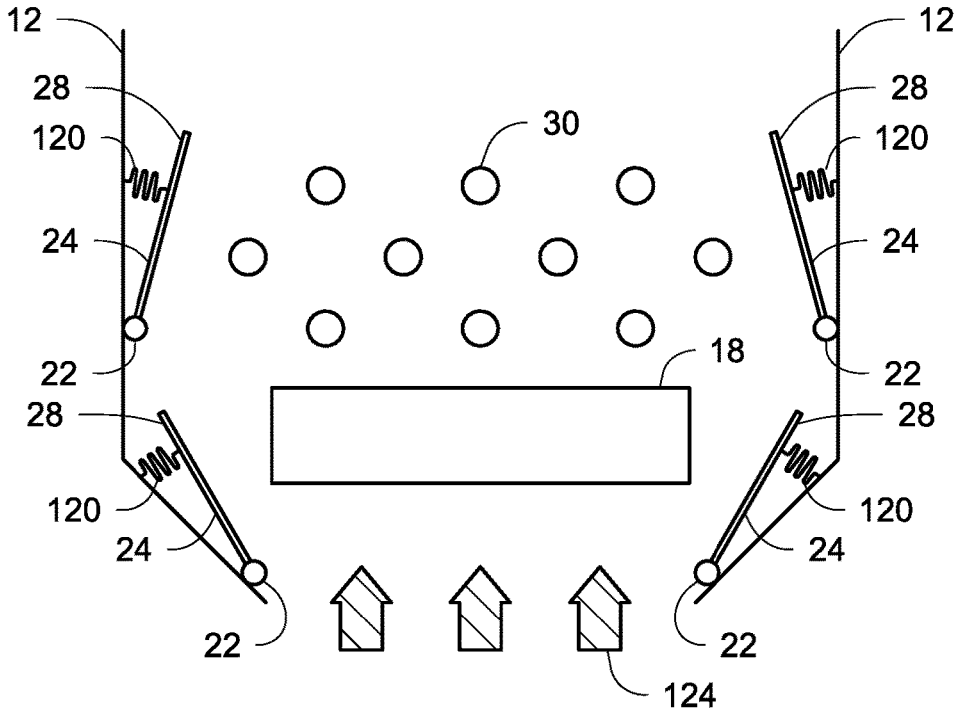
FIG. 4B is an embodiment of a furnace system with spring-positioned vanes in a cooling mode.

In some embodiments, the positioning of the vanes 24 in the baffles systems may be accomplished through variable-position mechanical connectors, such as one or more springs connecting a vane 24 to a side wall 12 of the furnace cabinet or to an element within the furnace cabinet 10, such as the secondary heat exchanger 18. In these embodiments, the vane is mechanically linked to a side wall 12 of the furnace cabinet 10 or to an element within the furnace cabinet 10 through a movable connection such as a hinge 22 or ball joint or swivel, and also mechanically linked to a side wall 12 of the furnace cabinet or to an element within the furnace through a spring 120. FIGS. 4A and 4B illustrate an embodiment of baffles systems with spring-controlled vanes when the baffles systems are being operated under two different airflow conditions. FIG. 4A depicts a heating mode, where the heating air flow 122 generated by the blower 14 is consistent with heating operations, and at a lower flow rate than that used for cooling operations. For example, in the heating mode of an embodiment, the heating airflow 122 may range between approximately 850 and approximately 1300 standard cubic feet per minute (SCFM), whereas the cooling airflow 124 may be in a range from approximately 1000 SCFM to approximately 1600 SCFM. In an embodiment, the drag force and the pressure differential operating on the vane that are created by the heating mode airflow 122 are insufficient to overcome the stiffness of the springs 120, thus the springs 120 holds the vanes 24 in the deployed position 26. FIG. 4B depicts a cooling mode, which operates at higher flow rates, the cooling mode airflow 124 creating more drag force and a higher pressure differential on the vanes 24 than is produced by heating mode airflow 122. As a result, the surface of vane 24 is exposed to a greater force during cooling operations than it is during heating operations. This increased force is sufficient to cross the actuation threshold and overcome spring stiffness to put the vanes 24 into their retracted positions 28, reducing the drag provided by the vanes 24, for example when in a cooling mode. The spring stiffness for each spring 120 is selected based on the size and shape of the vane linked to the spring, the position of the vane 24 in its deployed 26 and retracted 28 states, and the air flow rates for the heating airflow 122 and the cooling airflow 124. To determine the spring stiffness for the embodiment shown in FIGS. 4A and 4B, the force acting on a vane 24 may be computed for each of the heating and cooling modes, and the spring stiffness for that vane is selected so that it is compressed within the range between the force applied during heating modes and the larger force applied during cooling modes. The arrangement of vanes 24 and selection of spring stiffness may take into account the exit flows produced by particular positions for the vanes, for example by computing the heating mode forces acting on a vane 24 by modeling a system which includes the positions of other deployed vanes which are upstream with respect to the heating airflow 122 from the vane 24 connected to the spring 120 whose stiffness is being determined Guide vanes may in some embodiments be generally planar, or in some embodiments may have more complex shapes, for example featuring one or more bends or curved sections or surfaces. Example guide vane shapes which may be incorporated into some embodiments may be found in U.S. patent application Ser. No. 14/933,695 and U.S. Provisional Patent Application No. 62/076,974, which are herein incorporated by reference.

Aspects:

It is to be appreciated that any one of aspects 1-10 can be combined with any one of aspects 11-20. Any one of aspects 11-14 can be combined with any one of aspects 15-20.

Aspect 1. A furnace, comprising:

an air moving blower, a furnace cabinet, a secondary heat exchanger, a secondary heat exchanger baffles system comprising one or more movable vanes, a primary heat exchanger, a primary heat exchanger baffles system comprising one or more movable vanes, and an air conditioner coil.

Aspect 2. The furnace according to aspect 1, further comprising a vane position control for each of the movable vanes.

Aspect 3. The furnace according to any of aspects 1 or 2, wherein at least one of the vane position controls is a vane actuator.

Aspect 4. The furnace according to any of aspects 1-3, wherein the vane actuator is a servo motor.

Aspect 5. The furnace according to any of aspects 1-4, wherein the vane actuator is controlled by a controller supplying power to the vane actuator based on an actuation signal received from a thermostat or an integrated furnace control.

Aspect 6. The furnace according to any of aspects 1-4, wherein the vane actuator receives power from a power source coupled to a furnace component.

Aspect 7. The furnace according to any of aspects 1-6, wherein the furnace component is a gas valve or an inducer.

Aspect 8 The furnace according to any of aspects 1-6, wherein the furnace component is an air conditioner outdoor unit, a compressor, or a fan.

Aspect 9 The furnace according to any of aspects 1-8, wherein at least one of the vane position controls is a spring connected to the vane and connected to a wall of the furnace cabinet.

Aspect 10. The furnace of aspect according to any of aspects 1-9, wherein a stiffness of the spring is selected such that the movable vane is in a deployed position when exposed to a first airflow during heating operations, and wherein the movable vane is in a retracted position when exposed to a second airflow during cooling operations.

Aspect 11. A method for controlling airflows in a furnace, comprising:

positioning a plurality of movable vanes into an extended position during a heating operation of the furnace, and positioning the plurality of movable vanes into a retracted position during a cooling operation of the furnace, wherein a resistance to an airflow provided by the plurality of movable vanes is greater when the plurality of movable vanes are in the deployed position than the resistance to the airflow provided when the plurality of movable vanes are in the retracted position.

Aspect 12. The method according to aspect 11, wherein the positioning of the plurality of movable vanes comprises:

receiving a control signal at a controller indicative of a heating operation or a cooling operation, based on the control signal, the controller supplying power to an actuator mechanically linked to at least one of the plurality of movable vanes.

Aspect 13. The method according to any of aspects 11 or 12, wherein the positioning of the plurality of movable vanes comprises:

activating a power source linked to a component used either solely in heating operations or a component used solely in cooling operations directing at least a portion of power from the power source to an actuator mechanically linked to at least one of the plurality of movable vanes.

Aspect 14. The method according to any of aspects 11-13, wherein the positioning of the plurality of movable vanes comprises the application of force by the airflow to at least one of the plurality of movable vanes and compression of a spring connected to the vane based on the applied force.

Aspect 15. A control system for a movable vane in a furnace system, comprising:

a controller receiving a signal from a furnace component, a power source connected to the controller, an actuator mechanically linked to a movable vane, wherein the controller provides power to the actuator based on the signal received from the furnace component.

Aspect 16. The control system according to aspect 15 wherein the furnace component is an integrated furnace control or thermostat and wherein the signal is a call for heating or cooling.

Aspect 17. The control system according to any of aspects 15 or 16 wherein the furnace component is a controller connected to a gas valve or a controller connected to an inducer and wherein the signal is an activation signal for a gas valve or an inducer.

Aspect 18. The control system according to any of aspects 15-17, wherein the controller supplies power to the actuator when receiving the signal and the actuator moves the movable vane into a deployed position when supplied power by the controller.

Aspect 19. The control system according to any of aspects 15-18, wherein the furnace component is a controller connected to an air conditioner coil outdoor unit, a controller connected to a compressor, or a controller connected to a fan and wherein the signal is an activation signal for an air conditioner unit, a compressor or a fan.

Aspect 20. The control system according to any of aspects 15-19 wherein the controller supplies power to the actuator when receiving the signal and the actuator moves the movable vane into a retracted position when supplied power by the controller.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A control system for a movable vane in a furnace system, comprising:

a controller configured to receive a signal indicative of whether the furnace system is in a cooling mode versus a heating mode from a furnace component, a power source connected to the controller, an actuator mechanically linked to a movable vane, wherein the controller provides power to the actuator based on the signal received from the furnace component.

2. The control system of claim 1 wherein the furnace component is an integrated furnace control or thermostat and wherein the signal is a call for heating or cooling.

3. The control system of claim 1, wherein the furnace component is a controller connected to a gas valve or a controller connected to an inducer and wherein the signal is an activation signal for a gas valve or an inducer.

4. The control system of claim 3, wherein the controller configured to receive a signal indicative of whether the furnace system is in a cooling mode versus a heating mode from a furnace component supplies power to the actuator when receiving the signal and the actuator moves the movable vane into a deployed position when supplied power by the controller configured to receive a signal indicative of whether the furnace system is in a cooling mode versus a heating mode from a furnace component.

5. The control system of claim 1, wherein the furnace component is a controller connected to an air conditioner coil outdoor unit, a controller connected to a compressor, or a controller connected to a fan and wherein the signal is an activation signal for an air conditioner unit, a compressor or a fan.

6. The control system of claim 5 wherein the controller configured to receive a signal indicative of whether the furnace system is in a cooling mode versus a heating mode from a furnace component supplies power to the actuator when receiving the signal and the actuator moves the movable vane into a retracted position when supplied power by the controller configured to receive a signal indicative of whether the furnace system is in a cooling mode versus a heating mode from a furnace component.

* * * * *